US010519970B2

(12) United States Patent
Montgomery et al.

(10) Patent No.: US 10,519,970 B2
(45) Date of Patent: Dec. 31, 2019

(54) COMPRESSOR BLADE LOCKING MECHANISM IN DISK WITH TANGENTIAL GROOVE

(71) Applicant: Doosan Heavy Industries & Construction Co., Ltd., Gyeongsangnam-do (KR)

(72) Inventors: Matthew Montgomery, Gyeongnam (KR); Iurii Goroshchak, Gyeongnam (KR); Joohwan Kwak, Gyeongnam (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 252 days.

(21) Appl. No.: 15/428,881

(22) Filed: Feb. 9, 2017

(65) Prior Publication Data

US 2018/0223860 A1 Aug. 9, 2018

(51) Int. Cl.

*F01D 5/30* (2006.01)
*F04D 29/32* (2006.01)
*F01D 5/32* (2006.01)

(52) U.S. Cl.

CPC ..... *F04D 29/322* (2013.01); *F01D 5/30* (2013.01); *F01D 5/303* (2013.01); *F01D 5/3023* (2013.01); *F01D 5/32* (2013.01); *F05D 2260/36* (2013.01)

(58) Field of Classification Search

CPC . F01D 5/32; F01D 5/303; F01D 5/027; F01D 5/30; F04D 2260/30; F05D 2260/30
See application file for complete search history.

(56) References Cited

U.S. PATENT DOCUMENTS 3,088,708 A 5/1963 Feinberg
5,018,943 A * 5/1991 Corsmeier ..... F01D 5/027 416/144
6,647,602 B2 11/2003 Bachofner et al.
6,882,079 B2 * 4/2005 Kilpatrick ..... H02K 3/487 310/214
6,929,453 B2 8/2005 Kite et al.
7,435,055 B2 10/2008 Hansen et al.
(Continued)

FOREIGN PATENT DOCUMENTS

JP 2011-102585 A 5/2011
WO WO-2016195657 A1 * 12/2016 ..... F01D 5/3038

OTHER PUBLICATIONS

A Korean Office Action dated Mar. 28, 2019 in connection with Korean Patent Application No. 10-2018-0007925 which corresponds to the above-referenced U.S. application.

*Primary Examiner* — Dwayne J White
*Assistant Examiner* — Wesley Le Fisher
(74) *Attorney, Agent, or Firm* — Invenstone Patent, LLC

(57) ABSTRACT

A compressor blade locking device can include: a first support including a first locking groove; a second support including a left groove and a first protrusion corresponding to the first locking groove; a third support including a second locking groove; a fourth support including a right groove and a second protrusion corresponding to the second locking groove; a center support disposed between the second support and the fourth support; and a tab disposed in the center support, wherein the tab is configured to be turned such that the tab is disposed in the left groove and the right groove.

20 Claims, 6 Drawing Sheets

(56) References Cited

U.S. PATENT DOCUMENTS

| | | | | |
|---|---|---|---|---|
| 8,157,530 | B2 * | 4/2012 | Krutzfeldt | F01D 5/32 416/215 |
| 8,206,116 | B2 | 6/2012 | Pickens et al. | |
| 8,714,929 | B2 | 5/2014 | Joshi et al. | |
| 9,341,071 | B2 | 5/2016 | Healy et al. | |
| 2005/0129522 | A1 * | 6/2005 | Kite | F01D 5/32 416/220 R |
| 2006/0222502 | A1 * | 10/2006 | Hansen | F01D 5/3038 416/220 R |
| 2012/0114490 | A1 * | 5/2012 | Joshi | F01D 5/303 416/220 R |
| 2015/0101347 | A1 * | 4/2015 | Potter | F01D 5/323 60/805 |
| 2015/0101348 | A1 | 4/2015 | Hansen et al. | |
| 2018/0179902 | A1 * | 6/2018 | Goroshchak | F01D 5/32 |

* cited by examiner

COMPRESSOR BLADE LOCKING MECHANISM IN DISK WITH TANGENTIAL GROOVE

BACKGROUND OF THE INVENTION

A gas turbine generally comprises a compressor, a combustor, and a turbine, wherein the compressor provides compressed air generated by a plurality of compressor blades to the combustor. The plurality of compressor blades are engaged in a tangential groove of a disk and a plurality of spacers are engaged in the tangential groove between the plurality of compressor blades. Once the compressor blades and the spacers are installed sequentially in the tangential groove, the last remaining space in the tangential groove cannot be filled and secured by the compressor blades or the spacers because the remaining space is not enough for the spacer to be installed in the tangential groove. Thus, in the conventional design, a multi-piece spacer is used in such a manner that multiple parts are inserted into the remaining space and combined with each other. However, the prior multi-piece spacer comprises so many parts including bolts and nuts that it is possible for multi-piece parts to disassemble and be released into the compressor blades, thereby causing damage to the compressor blades.

BRIEF SUMMARY

The present invention relates to a compressor for a gas turbine, more particularly, to a compressor blade locking device for a compressor blade engaged in a tangential groove of a disk.

Exemplary embodiments of the subject invention relate to a compressor blade locking device that substantially obviates one or more of the above disadvantages/problems and provides one or more of the advantages as mentioned below. In many embodiments, a compressor blade locking device comprises a tab configured to be turned in a center support such that the tab is inserted into a left groove and a right groove.

In an embodiment of the present invention, a compressor blade locking device can include: a left support including a left groove; a right support including a right groove; a center support disposed between the left support and the right support; and a tab disposed in the center support, wherein the tab is configured to be turned in the center support such that the tab is inserted into the left groove and the right groove.

In another embodiment of the present invention, a compressor bladed disk can include: a disk including a tangential groove; a plurality of compressor blades engaged in the tangential groove of the disk; and a first locking device engaged in the tangential groove of the disk, wherein the first locking device comprises: a left support including a left groove and a first tangential groove corresponding to the tangential groove of the disk; a right support including a right groove and a second tangential groove corresponding to the tangential groove of the disk; a center support disposed between the left support and the right support; and a tab configured to be turned in the center support such that the tab is inserted into the left groove and the right groove.

In another embodiment of the present invention, a compressor blade locking device can include: a first support including a first locking groove; a second support including a left groove and a first protrusion corresponding to the first locking groove; a third support including a second locking groove; a fourth support including a right groove and a second protrusion corresponding to the second locking groove; a center support disposed between the second support and the fourth support; and a tab disposed in the center support, wherein the tab is configured to be turned such that the tab is inserted into the left groove and the right groove.

DETAILED DISCLOSURE

Figure 1:
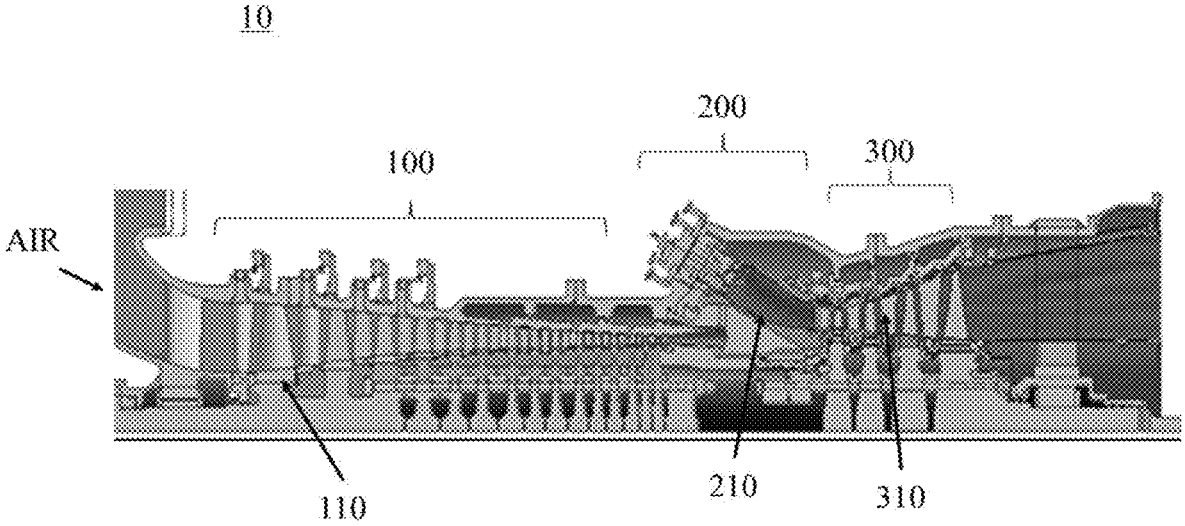
FIG. 1 is a cross-sectional view of a gas turbine according to an embodiment of the subject invention.

When the terms "on" or "over" are used herein, when referring to layers, regions, patterns, or structures, it is understood that the layer, region, pattern, or structure can be directly on another layer or structure, or intervening layers, regions, patterns, or structures may also be present. When the terms "under" or "below" are used herein, when referring to layers, regions, patterns, or structures, it is understood that the layer, region, pattern, or structure can be directly under the other layer or structure, or intervening layers, regions, patterns, or structures may also be present. The terms "includes" and "including" are equivalent to "comprises" and "comprising," respectively.

In addition, references to "first", "second", and the like (e.g., first and second portion), as used herein, and unless otherwise specifically stated, are intended to identify a particular feature of which there may be more than one. Such reference to "first" does not imply that there must be two or more. These references are not intended to confer any order in time, structural orientation, or sidedness (e.g., left or right) with respect to a particular feature, unless explicitly stated. In addition, the terms "first" and "second" can be selectively or exchangeably used for the members.

Furthermore, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated. That is, a dimension of each of the elements may be exaggerated for clarity of illustration, and the dimension of each of the elements may be different from an actual dimension of each of the elements. Not all elements illustrated in the drawings must be included and limited to the present disclosure, but the elements except essential features of the present disclosure may be added or deleted.

It is to be understood that the figures and descriptions of embodiments of the present invention have been simplified to illustrate elements that are relevant for a clear understanding of the invention, while eliminating (in certain cases), for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

Reference will be made to the attached figures on which the same reference numerals are used throughout to indicate the same or similar components. With reference to the attached figures, which show certain embodiments of the subject invention, it can be seen in FIG. 1 that, in an embodiment, a gas turbine 10 includes a compressor 100 having a compressor blade 110, a combustor 200 having a combustion chamber 210, and a turbine 300 having a turbine blade 310. Air is provided according to the arrow direction to the compressor blade 110 and compressed in the compressor 100, and then the compressed air is provided to the combustor 200. The air may pass through several compressor blades 110 located in several stages in an axial direction and be gradually compressed. The compressed air provided by the compressor 100 is combusted with a fuel in the combustion chamber 210, thereby producing a hot gas. The hot gas generated in the combustion chamber 210 is supplied to the turbine blade 310 such that the turbine blade 310 turns.

Figure 2A:
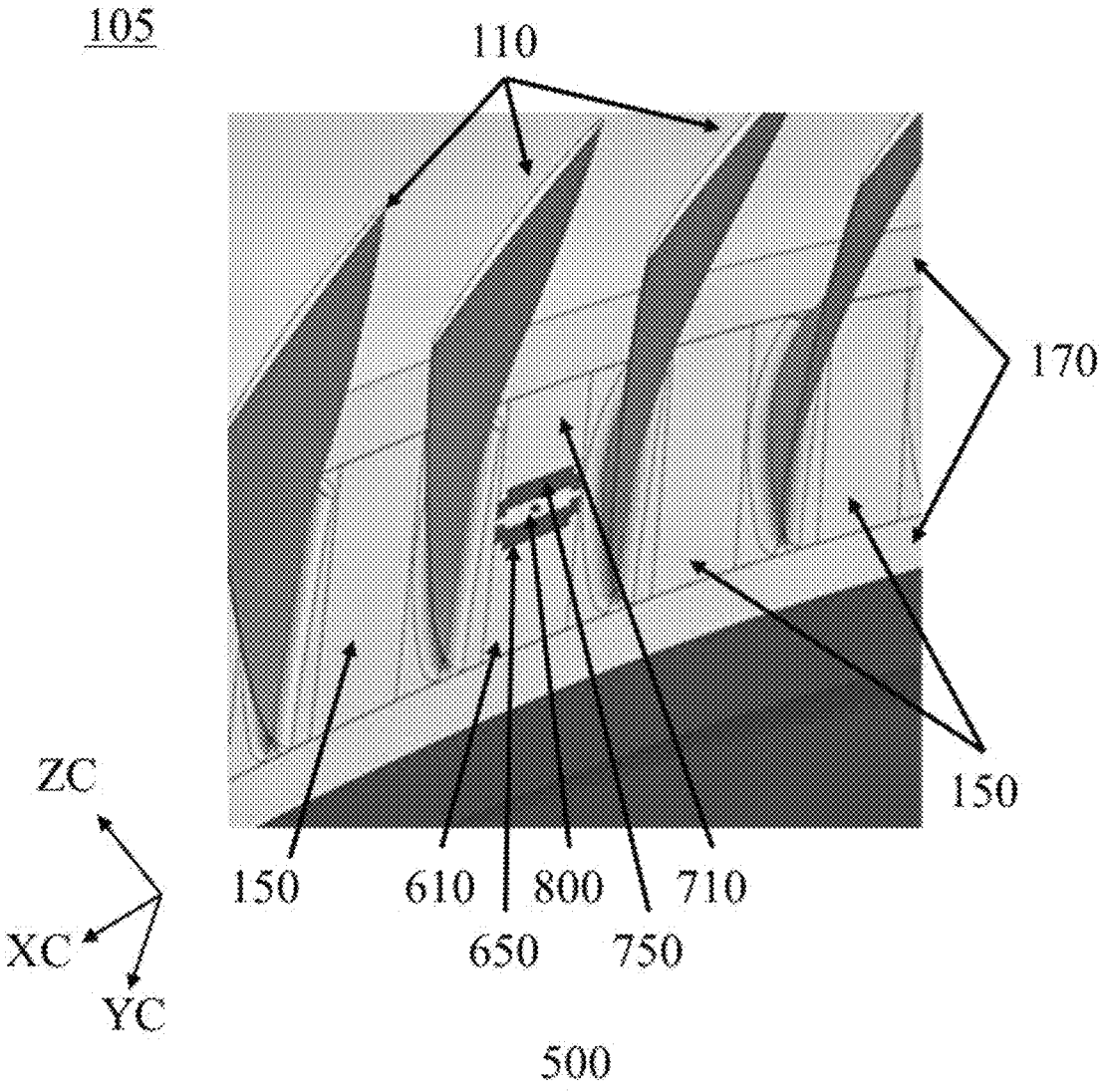
FIGS. 2(*a*) and 2(*b*) are perspective views of a compressor bladed disk according to a first embodiment of the subject invention.
Figure 2B:
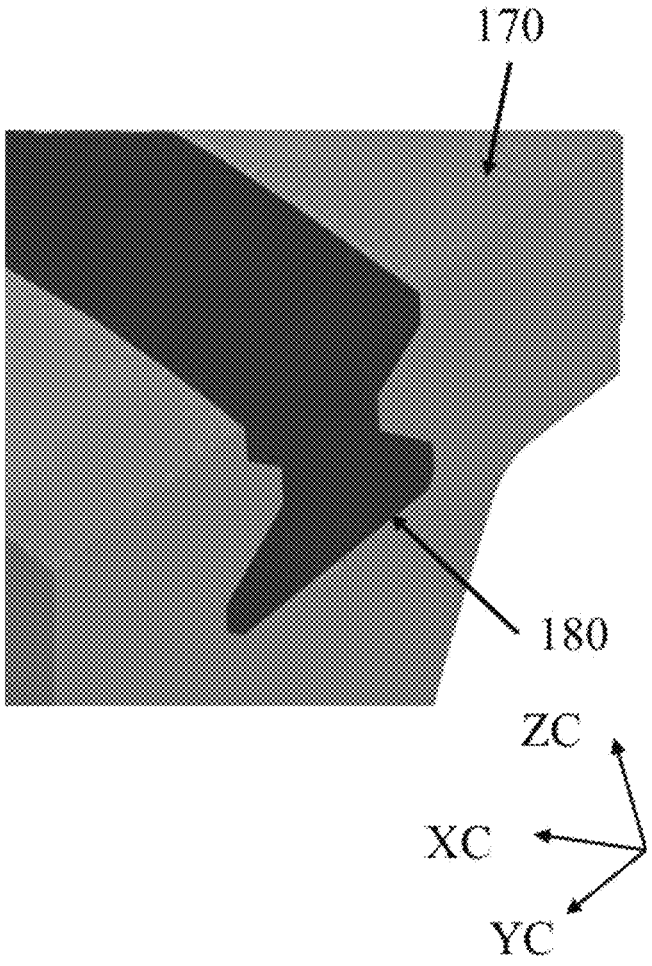

FIGS. 2(*a*) and 2(*b*) are perspective views of a compressor bladed disk according to a first embodiment of the subject invention. A compressor bladed disk 105 can be used in any stage in the compressor 100 and the compressor bladed disk 105 can be coupled with another compressor bladed disk 105.

The compressor bladed disk 105 includes a disk 170 having a rim shape, a plurality of compressor blades 110 engaged with the disk 170, a plurality of spacers 150 engaged with the disk 170, and a compressor blade locking device 500 engaged with the disk 170, thereby filing a space in a tangential groove 180 of the disk 170. The spacers 150 are placed between the compressor blades 110 and the compressor blade locking device 500 is placed between the compressor blades 110.

Each of the compressor blades 110 and the spacers 150 is inserted into the tangential groove 180 of the disk 170 in a radial direction ZC and then turned such that the compressor blades 110 and the spacers 150 are aligned along an axial direction YC in the tangential groove 180 of the disk 170. Thus, the compressor blades 110 are inhibited from being disengaged from the disk 170 in the radial direction ZC and in the axial direction YC. The compressor blades 110 and the spacers 150 are placed alternately in the tangential groove 180 along a tangential direction XC. The remaining space in the tangential groove 180 of the disk 170 that the compressor blades 110 and the spacer 150 do not fill is filled by inserting the compressor blade locking device 500 including a first support 610, a second support 650, a third support 710, a fourth support 750, and a center support 800. Each of the first support 610, the second support 650, the third support 710, the fourth support 750, and the center support 800 is inserted separately and then coupled with each other such that the compressor blade locking device 500 is not disengaged from the disk 170.

Figure 3:
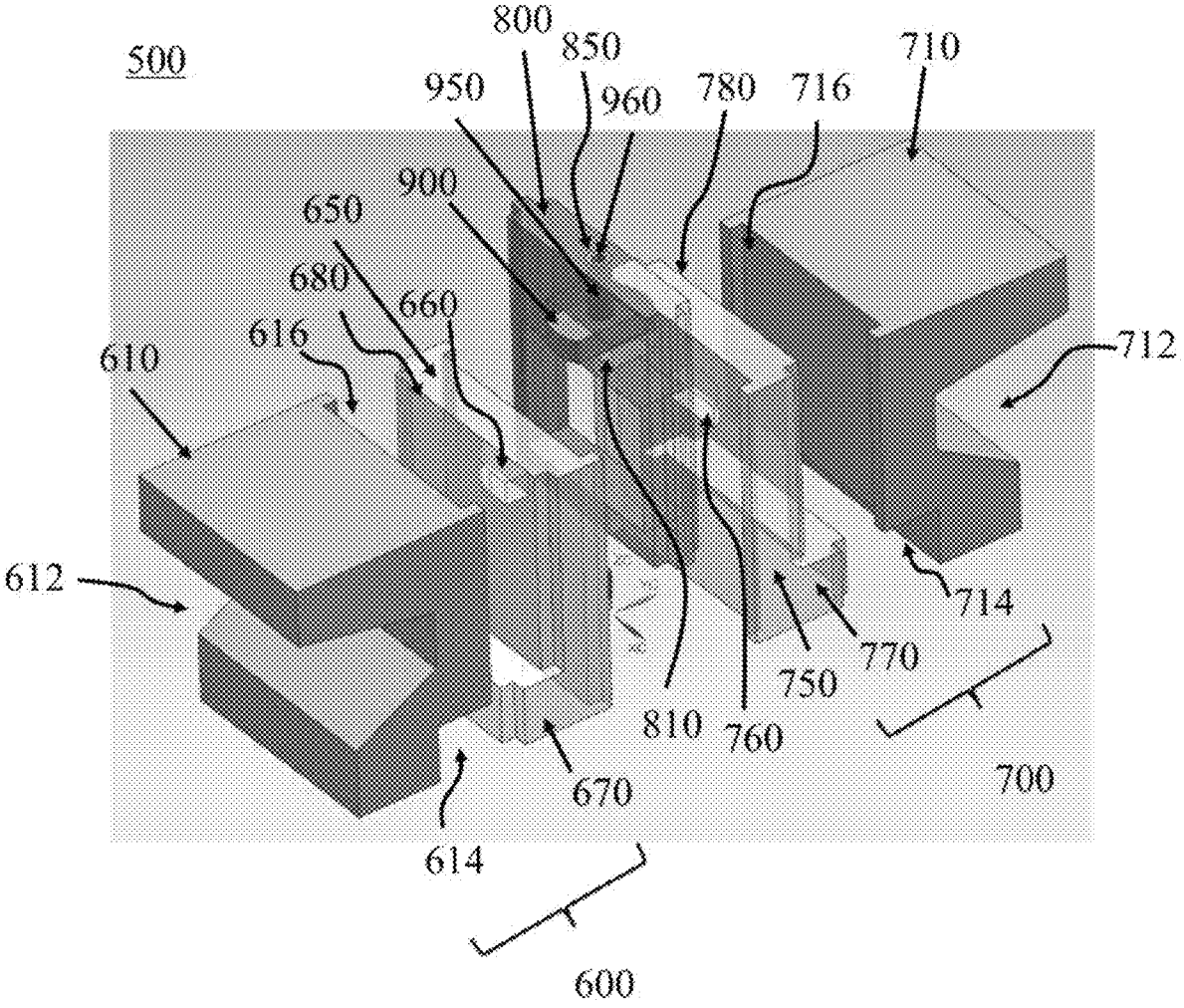
FIG. 3 is an expanded view of a compressor blade locking device according to a first embodiment of the subject invention.

FIG. 3 is an expanded view of a compressor blade locking device according to a first embodiment of the subject invention. Referring to FIG. 3, it can be seen that in this embodiment, a compressor blade locking device 500 comprises a left support 600, a right support 700, a center support 800, and a tab 900. The left support 600 can comprise a first support 610 and a second support 650 and the right support 700 can comprise a third support 710 and a fourth support 750.

The first support 610 includes a first tangential groove 612 configured to correspond to the tangential groove of the disk and a first locking groove 614 corresponding to a first protrusion 670 of the second support 650. The first tangential groove 612 secures the first support 610 to the disk and the first locking groove 614 secures the first support 610 to the second support 650. In addition, the first support 610 can include a first radial groove 616 that is configured to be coupled with a first protruding surface 680 of the second support 650.

Similarly, the third support 710 includes a second tangential groove 712 configured to correspond to the tangential groove of the disk, a second locking groove 714 corresponding to a second protrusion 770 of the fourth support 750, and a second radial groove 716 coupled with a second protruding surface 780 of the fourth support 750.

The center support 800 is interposed between the second support 650 and the fourth support 750 and the tab 900 is disposed in a horizontal hole 810 of the center support 800. The horizontal hole 810 passes through the center support 800 in the axial direction YC (e.g. horizontal direction) and the tab 900 is configured to be turned in the horizontal hole 810. The center support 800 comprises a vertical hole 850 extending from the horizontal hole 810 along the radial direction ZC (e.g., vertical direction) and the tab 900 comprises a tab support 950 inserted into the vertical hole 850 of the center support 800, thereby providing coupling between the tab 900 and the center support 800. The tab support 950 can include a tab hole 960 that is configured to be combined with a wrench (not shown).

The second support 650 is placed between the first support 610 and the center support 800 and includes the first protrusion 670 facing the first support 610 and a left groove 660 facing the center support 800. The first protrusion 670 is coupled with the first locking groove 614 of the first support 610, thereby securing the second support 650 to the first support 610. The left groove 660 is aligned to the horizontal hole 810 of the center support 800 and configured such that the tab 900 is inserted into the left groove 660. That is, the tab 900 is capable of turning from the tangential direction XC to the axial direction YC in the horizontal hole 810, and in case the tab 900 is aligned along the axial direction YC, the tab 900 is inserted into the left groove 660 of the second support 650, thereby securing the second support 650 to the center support 800.

The fourth support 750 is placed between the third support 710 and the center support 800 and includes the second protrusion 770 facing the third support 710 and a right groove 760 facing the center support 800. The second protrusion 770 is coupled with the second locking groove 714 of the third support 710, thereby securing the fourth support 750 to the third support 710. The right groove 760 is aligned to the horizontal hole 810 of the center support 800 and configured to be inserted by the tab 900. That is, in case the tab 900 is turned from the tangential direction XC to the axial direction YC, the tab 900 is inserted into the right groove 760 of the fourth support 750, thereby securing the fourth support 750 to the center support 800.

Each of the left groove 660 and right groove 760 can include a curved surface and a flat surface in the tangential direction XC. When the tab 900 is turned into the left 660 and right 760 grooves, the curved surface provides a space for the tab 900 and the flat surface blocks turning of the tab 900. The depth of the each of the left 660 and right 760 grooves is configured that both distal ends of the tab 900 are disposed in the left 660 and right 760 grooves.

Figure 4:
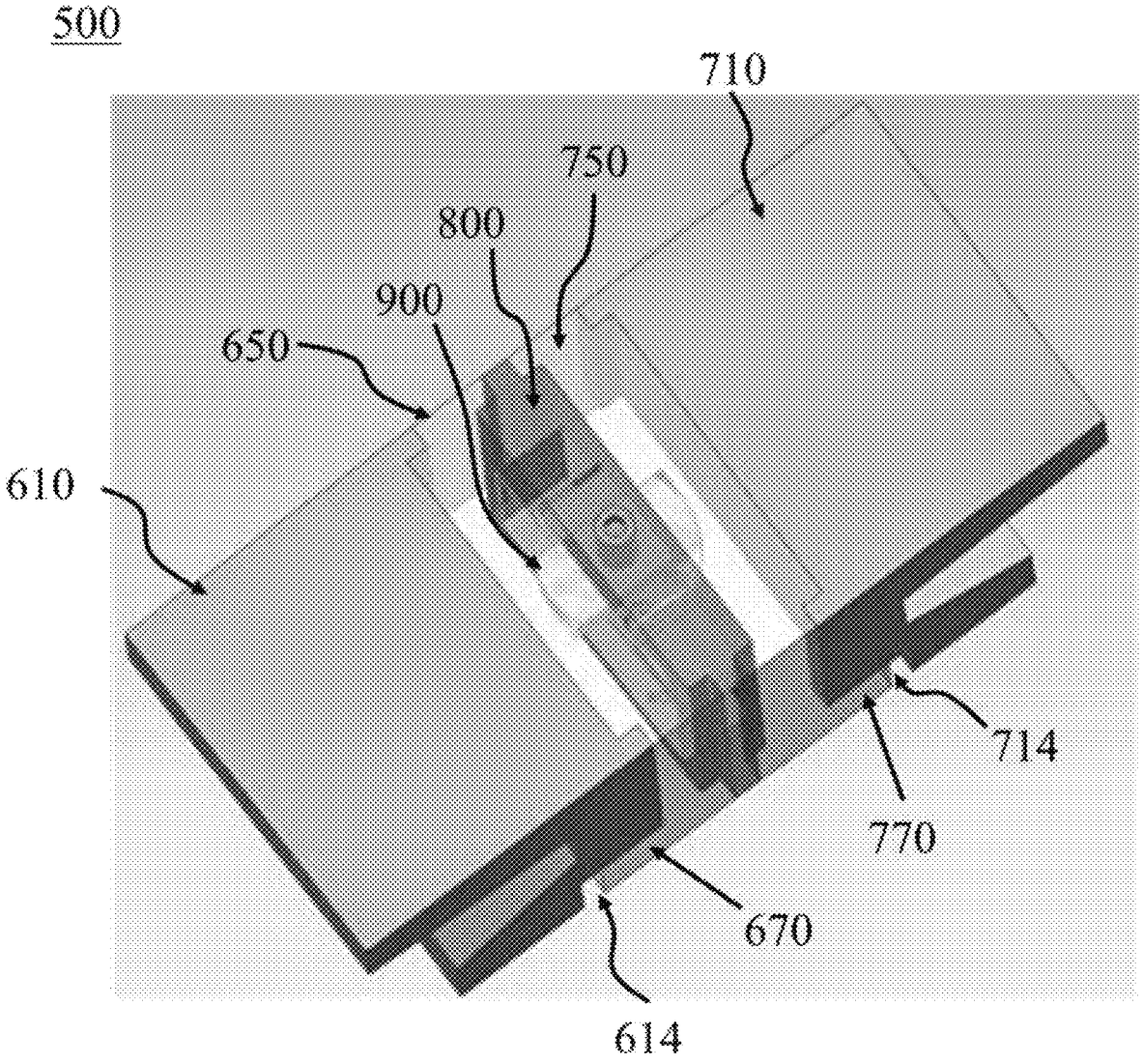
FIG. 4 is a perspective view of a compressor blade locking device according to a first embodiment of the subject invention.

FIG. 4 is a perspective view of a compressor blade locking device according to a first embodiment of the subject invention. Referring to FIG. 4, all components of the compressor blade locking device 500 are secured to each other. The first support 610 and the second support 650 are secured to each other through the coupling between the first locking groove 614 and the first protrusion 670. The third support 710 and the fourth support 750 are secured to each other through the coupling between the second locking groove 714 and the second protrusion 770. In addition, the center support 800 is secured to the second support 650 and the fourth support 750 by the tab 900 that is passing through the center support 800 and inserted into the second support 650 and the fourth support 750.

Referring to FIGS. 2-4, the parts of the compressor blade locking device 500 are separately inserted into the tangential groove 180 of the disk 170 and then secured to each other, thereby filling the tangential groove 180 and inhibiting the compressor blade locking device 500 from being disengaged from the tangential groove 180. First, the first support 610 and the third support 710 are inserted into the tangential groove 180 such that the first tangential groove 612 and the second tangential groove 712 are secured by the tangential groove 180. Second, the second support 650 and the fourth support 750 are inserted into the tangential groove 180 and then moved to the first 610 and third 710 supports, respectively, such that the first protrusion 670 is coupled with the first locking groove 614 and the second protrusion 770 is coupled with the second locking groove 714. Third, the center support 800 is inserted into the tangential groove 180 between the second support 650 and the fourth support 750, wherein the tab 900 is aligned to the tangential direction XC in the horizontal hole 810. Fourth, the tab 900 is turned in a counterclockwise direction by 90 degrees, thereby placing the tab 900 in the axial direction YC. As a result, all parts of the compressor blade locking device 500 are secured to each other and the compressor blade locking device 500 is secured to the disk 170.

In case the compressor blade locking device 500 needs to be disengaged from the disk 170, the tab 900 is turned to be aligned along the tangential direction XC in the horizontal hole 810, thereby decoupling the center support 800 from the second support 650 and the fourth support 750. The decoupled center support 800 is removed from the tangential groove 180 of the disk 170, and then the second support 650 and the fourth support 750 are moved toward an empty space that is provided by the removed center support 800, thereby decoupling the second support 650 and the fourth support 750 from the first support 610 and the third support 710, respectively. The decoupled the second support 650 and the fourth support 750 are also removed from the tangential groove 180, and then the first support 610 and the third support 710 are removed easily from the tangential groove 180, thereby providing an empty space in the tangential groove 180 such that the spacer 150 or the compressor blade 110 can move in the empty space of the tangential groove 180.

A plurality of the compressor blade locking device 500 can be inserted into several positions of the tangential groove 180. For example, the first and second compressor blade locking devices are placed in the tangential groove such that the first and second compressor blade locking devices are point symmetric with respect to an axis of the disk, or four compressor blade locking devices are placed in the tangential groove such that the four compressor blade locking devices are spaced apart from each other by 90 degrees. In addition, the center support 800 can include a hollow in order to decrease a weight of the center support 800, thereby balancing a weight of the compressor blade locking device 500 against a weight of the spacer 150 or a weight of the compressor blade 110.

Figure 5A:
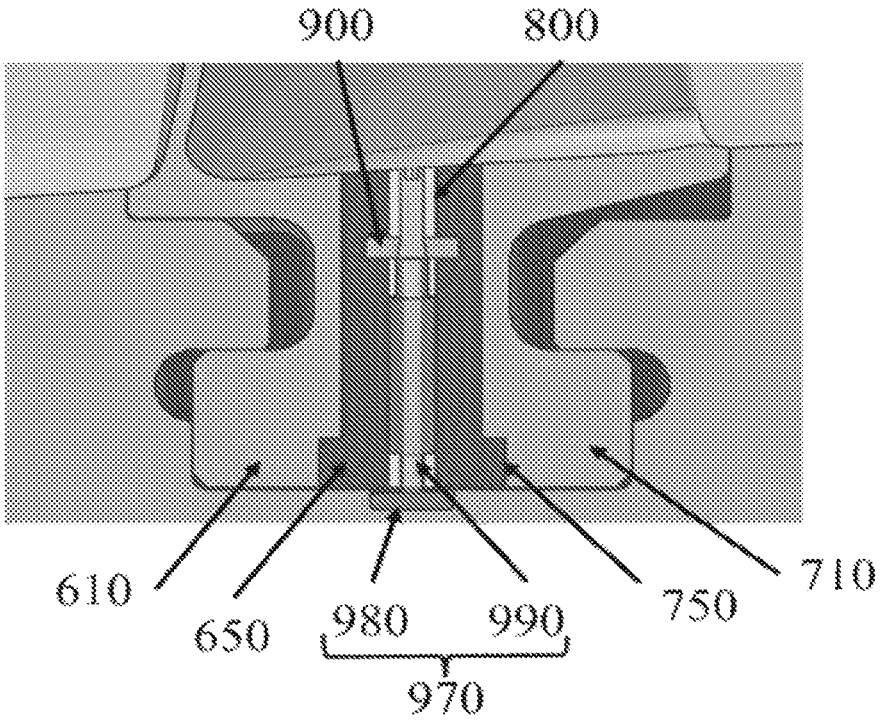
FIGS. 5(*a*) and 5(*b*) are a cross-sectional view and an expanded view of a compressor blade locking device according to a second embodiment of the subject invention.
Figure 5B:
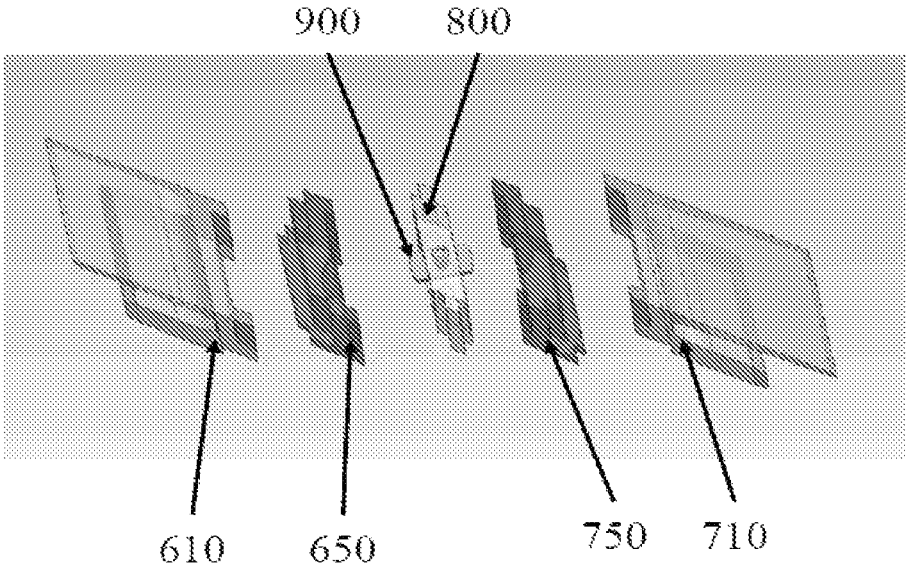

FIGS. 5(*a*) and 5(*b*) are a cross-sectional view and an expanded view of a compressor blade locking device according to a second embodiment of the subject invention. Referring to FIGS. 5(*a*) and 5(*b*), the compressor blade locking device 500 includes center post 970 coupled with the center support 800, the second support 650, and the fourth support 750. In particular, the center post 970 includes a post head 980 and a post tail 990, wherein the post tail 990 is coupled with the center support 800 and the post head 980 is in contact with bottom surfaces of the second support 650 and the fourth support 750, thereby securing the center support 800 to the second support 650 and the fourth support 750.

It should be understood that the examples and embodiments described herein are for illustrative purposes only and that various modifications or changes in light thereof will be suggested to persons skilled in the art and are to be included within the spirit and purview of this application. Thus, the invention is not intended to limit the examples described herein, but is to be accorded the widest scope consistent with the principles and novel features disclosed herein.

What is claimed is:

1. A compressor blade locking device, comprising:

a left support including a left groove;

a right support including a right groove;

a center support that includes a radial axis and is disposed between the left support and the right support; and a tab that includes opposite distal ends and is rotatably disposed in the center support on the radial axis, wherein the tab is configured to be turned in the center support about the radial axis such that the opposite distal ends of the tab are respectively disposed in the left groove and the right groove.

2. The compressor blade locking device according to claim 1, wherein the left support includes a center facing surface in which the left groove is recessed to a predetermined depth for receiving one of the opposite distal ends of the tab, the right support includes a center facing surface in which the right groove is recessed to a predetermined depth for receiving the other of the opposite distal ends of the tab, the center support includes left and right facing surfaces through which is formed a horizontal hole aligned in an axial direction with each of the left and right grooves, and the tab is capable of turning in the horizontal hole.

3. The compressor blade locking device according to claim 1, wherein the center support includes a vertical hole that coincides with the radial axis and the tab is coupled with the center support through a tab support disposed in the vertical hole.

4. The compressor blade locking device according to claim 3, wherein the tab support includes a tab hole.

5. The compressor blade locking device according to claim 2, wherein the left support includes a first support having a first locking groove and a second support having a first protrusion, and the first locking groove corresponds to the first protrusion.

6. The compressor blade locking device according to claim 5, wherein the first protrusion of the second support extends toward the first support.

7. The compressor blade locking device according to claim 6, wherein the first support includes a first radial groove in a vertical direction, and a first protruding surface of the second support is inserted into the first radial groove.

8. The compressor blade locking device according to claim 1, further comprising a center post inserted into the center support, wherein the center post is coupled with a bottom surface of the left support and a bottom surface of the right support.

9. A compressor bladed disk, comprising:

a disk including a tangential groove;

a plurality of compressor blades engaged in the tangential groove of the disk; and a first locking device engaged in the tangential groove of the disk, wherein the first locking device comprises:

a left support including a left groove and a first tangential groove corresponding to the tangential groove of the disk;

a right support including a right groove and a second tangential groove corresponding to the tangential groove of the disk;

a center support that includes a radial axis and is disposed between the left support and the right support; and a tab that includes opposite distal ends and is rotatably disposed in the center support on the radial axis, wherein the tab is configured to be turned in the center support about the radial axis such that the opposite distal ends of the tab are respectively disposed in the left groove and the right groove.

10. The compressor bladed disk according to claim 9, further comprising a spacer engaged in the tangential groove of the disk, wherein the spacer is placed between the plurality of compressor blades.

11. The compressor bladed disk according to claim 9, wherein the left support includes a center facing surface in which the left groove is recessed to a predetermined depth for receiving one of the opposite distal ends of the tab, the right support includes a center facing surface in which the right groove is recessed to a predetermined depth for receiving the other of the opposite distal ends of the tab, the center support includes left and right facing surfaces through which is formed a horizontal hole aligned in an axial direction of the disk with each of the left and right grooves, and the tab is placed in the horizontal hole.

12. The compressor bladed disk according to claim 11, wherein the horizontal hole is enclosed in a radial direction and a tangential direction of the disk.

13. The compressor bladed disk according to claim 12, wherein the tab is configured to be inserted into the left groove and the right groove, and to pass through the horizontal hole.

14. The compressor bladed disk according to claim 13, wherein each of the left and right grooves includes first and second ends separated in the tangential direction, a curved surface communicating with the center facing surface at the first end, and a flat surface communicating with the curved surface and extending from the curved surface in the tangential direction to the second end, and wherein the curved surface is configured to receive the tab during a rotation of the tab and the flat surface is configured to receive the tab after the rotation.

15. The compressor bladed disk according to claim 13, wherein the center support includes a vertical hole extending from the horizontal hole in the radial direction.

16. The compressor bladed disk according to claim 15, wherein the tab includes a tab support inserted into the vertical hole of the center support.

17. The compressor bladed disk according to claim 16, wherein the left support includes a first support having the first tangential groove and a second support having the left groove, and the right support includes a third support having the second tangential groove and a fourth support having the right groove.

18. The compressor bladed disk according to claim 9, further comprising a second locking device engaged in the tangential groove of the disk.

19. The compressor bladed disk according to claim 18, wherein the second locking device is placed in the tangential groove such that the first and second locking devices are point symmetric with respect to an axis of the disk.

20. A compressor blade locking device, comprising: a first support including a first locking groove;

a second support including a left groove and a first protrusion corresponding to the first locking groove;

a third support including a second locking groove;

a fourth support including a right groove and a second protrusion corresponding to the second locking groove;

a center support that includes a radial axis and is disposed between the second support and the fourth support; and a tab disposed in the center support, wherein the tab is configured to be turned in the center support about the radial axis such that opposite distal ends of the tab are respectively disposed in the left groove and the right groove.

* * * * *